US007331616B2

(12) United States Patent
Brei et al.

(10) Patent No.: US 7,331,616 B2
(45) Date of Patent: Feb. 19, 2008

(54) HOOD LATCH ASSEMBLIES UTILIZING ACTIVE MATERIALS AND METHODS OF USE

(75) Inventors: Diann Brei, Milford, MI (US); John Redmond, Ann Arbor, MI (US); Nathan A. Wilmot, Waterford, MI (US); Alan L. Browne, Grosse Pointe, MI (US); Nancy L. Johnson, Northville, MI (US); Gary L. Jones, Farmington Hills, MI (US)

(73) Assignees: General Motors Corporation, Detroit, MI (US); University of Michigan, Ann Arbor, MI (US)

( * ) Notice: Subject to any disclaimer, the term of this patent is extended or adjusted under 35 U.S.C. 154(b) by 169 days.

(21) Appl. No.: 10/893,118

(22) Filed: Jul. 15, 2004

(65) Prior Publication Data

US 2006/0012191 A1 Jan. 19, 2006

(51) Int. Cl.
*E05C 19/10* (2006.01)
*E05C 3/06* (2006.01)

(52) U.S. Cl. ..... 292/100; 292/201; 292/341.16; 292/DIG. 66

(58) Field of Classification Search ..... 292/100, 292/4, 57, 59, 60, 63, 96, 109, 300, 304, 292/251.5, 341.18, DIG. 5, DIG. 14, DIG. 29, 292/DIG. 51, DIG. 60, DIG. 66, 137, 201, 292/216, DIG. 23, 341.16, 341.15
See application file for complete search history.

(56) References Cited

U.S. PATENT DOCUMENTS

| | | | | | |
|---|---|---|---|---|---|
| 458,180 | A | * | 8/1891 | Lyons | 292/4 |
| 1,321,582 | A | * | 11/1919 | Ainsworth | 292/57 |
| 1,376,122 | A | * | 4/1921 | Songey | 292/57 |
| 1,496,172 | A | * | 6/1924 | Rogers | 292/57 |
| 2,631,877 | A | * | 3/1953 | Ainsworth | 292/57 |
| 2,901,053 | A | * | 8/1959 | Lassiter | 180/289 |
| 2,975,531 | A | * | 3/1961 | Malenich | 434/365 |
| 3,322,451 | A | * | 5/1967 | Bredemus | 292/137 |
| 3,572,068 | A | | 3/1971 | Carlson | 70/241 |
| 3,664,698 | A | | 5/1972 | Stropkay | 292/201 |
| 4,505,501 | A | * | 3/1985 | Fuchs et al. | 292/62 |
| 4,551,975 | A | * | 11/1985 | Yamamoto et al. | 60/528 |
| 4,618,180 | A | * | 10/1986 | Muscat | 296/120.1 |
| 4,702,094 | A | | 10/1987 | Peterson | |

(Continued)

FOREIGN PATENT DOCUMENTS

| | | |
|---|---|---|
| DE | 43 27 381 | 2/1995 |

(Continued)

*Primary Examiner*—Carlos Lugo

(57) ABSTRACT

A latch for engaging and disengaging two opposing surfaces includes a pin disposed on one surface and a gate disposed on an opposite surface; an active material in operative communication with the pin or the gate; an activation device in operative communication with the active material, wherein the activation device is operable to selectively apply an activation signal to the active material and effect a reversible change in a property of the active material, wherein the reversible change results in an engagement or a disengagement of the pin or the gate from the other of the pin or the gate; and a spring in operative communication with the pin or the gate, wherein the spring is configured to provide a force opposite to a force provided by the active material, wherein the activated active material is effective to overcome the force provided by the spring

20 Claims, 8 Drawing Sheets

U.S. PATENT DOCUMENTS 4,744,392 A * 5/1988 Tade et al. ..... 138/89
4,783,102 A * 11/1988 Bernard ..... 292/216
4,806,815 A * 2/1989 Honma ..... 310/307
4,997,218 A * 3/1991 Culling ..... 292/60
5,046,768 A * 9/1991 Myslicki ..... 292/68
5,104,163 A * 4/1992 Palmer et al. ..... 292/335
5,120,093 A * 6/1992 Carney ..... 292/60
5,213,380 A * 5/1993 Thometschek et al. ..... 292/59
5,280,973 A * 1/1994 Culling ..... 292/58
5,618,066 A * 4/1997 Fu-Hsiang ..... 292/62
5,707,095 A * 1/1998 Pribak et al. ..... 296/57.1
5,725,928 A 3/1998 Kenney et al.
6,008,992 A * 12/1999 Kawakami ..... 361/726
6,086,599 A 7/2000 Lee et al.
6,102,452 A * 8/2000 Liau ..... 292/175
6,428,080 B1 8/2002 Ochoa
6,871,519 B2 * 3/2005 Butera et al. ..... 70/256
2002/0007884 A1 1/2002 Schuster et al.
2004/0035687 A1 2/2004 von Behrens et al. ..... 200/6
2004/0104580 A1 6/2004 Spiessl et al. ..... 292/84

FOREIGN PATENT DOCUMENTS

DE 199 24 685 11/2000
EP 1 245 762 10/2002
EP 1 279 784 1/2003
EP 1 300 532 4/2003
FR 2 833 543 6/2003
GB 462482 * 3/1937
WO WO 01/84002 A2 11/2002
WO PCT 2004/001170 12/2003

* cited by examiner

HOOD LATCH ASSEMBLIES UTILIZING ACTIVE MATERIALS AND METHODS OF USE

BACKGROUND

The present disclosure generally relates to hood latch assemblies for use in an automotive vehicle, wherein the hood latch assembly includes the use of active materials.

Numerous motor vehicles employ a hingeable hood disposed in a region between the passenger compartment and the forward bumper of the motor vehicle, and between the passenger compartment and the rearward bumper of the motor vehicle. The hingeable hood provides a mechanism for accessing the underlying engine or storage compartment and is typically formed of a relatively thin sheet of metal or plastic that is molded to the appropriate contour corresponding to the overall vehicle body design. The hingeable hood also includes a latch system, which is primarily used for securing the hood to the vehicle body.

Many latch systems typically include a striker on the hood, a primary latching member on the vehicle body engageable with the striker to secure the hood in a closed or latched position, and a secondary latching member on the vehicle body in the path taken by the striker from the latched position. The secondary latching member acts as an additional safety device to prevent the hood from opening in the event that the primary latching member unintentionally disengages.

Very often the primary latching member is cable-operated from inside the vehicle and the secondary latching member is manually operated upon (e.g., by a handle). The secondary latching member usually has an actuating handle that is accessible to a person's fingers when the person is standing in close proximity to the latch system. The actuating handle must be pushed or pulled in a specific direction in order to release the secondary latching member from the striker.

Current latch systems are limited in that the process of reaching and operating the handle of the secondary latching member may be difficult for those who may not be aware of the handle construction or movement direction required to disengage the secondary latching member from the striker. The process may be more difficult under conditions of limited visibility; the operation must then be carried out using only the sense of feel to find and operate the handle.

Another limitation of current latch systems is that they typically provide single site lock down of the hood to the vehicle body. The single latch system in addition to hinges and any support structure, such as a contoured plate with stamped rib supports extending across the underside of the hood, provide a limited number of paths for distribution of a load, and consequently energy absorption, during an impact event. Furthermore, would-be thieves need only disengage the single latch system in order to access the contents of the engine or storage compartment.

Despite their suitability for their intended purposes, there nonetheless remains a need in the art for improved motor vehicle hood latch systems. It would be particularly advantageous if such latch systems could result in less difficulty during operation, and/or provide or permit greater energy to be absorbed during an impact event, and/or provide increased security against theft.

BRIEF SUMMARY

Disclosed herein is a latch comprising a pin disposed on a first surface; a gate disposed on a second surface opposing the first surface; an active material in operative communication with the pin or the gate, wherein the active material comprises a shape memory alloy, a ferromagnetic shape memory alloy, a shape memory polymer, a magnetorheological fluid, an electroactive polymer, a magnetorheological elastomer, an electrorheological fluid, a piezoelectric material, or combinations comprising at least one of the foregoing active materials; and an activation device in operative communication with the active material, wherein the activation device is operable to selectively apply an activation signal to the active material and effect a reversible change in a property of the active material, wherein the reversible change results in an engagement or a disengagement of the pin or the gate from the other of the pin or the gate, wherein the disengagement without the activation signal is opposed by a lifting force.

Also disclosed herein is a method comprising producing an activation signal with an activation device; applying the activation signal to an active material and causing a change in at least one property of the active material, wherein the active material is in operative communication with a pin or a gate of a latch, wherein the pin is disposed on a first surface and the gate is disposed on an opposing second surface; and engaging the latch by the change in at least one property of the active material to secure the first surface to the opposing second surface or disengaging the latch by the change in at least one property of the active material to make less secure the first surface to the opposing second surface.

The above described and other features are exemplified by the following figures and detailed description.

BRIEF DESCRIPTION OF THE DRAWINGS

Referring now to the figures, which are exemplary embodiments and wherein like elements are numbered alike.

DETAILED DESCRIPTION

Figure 1:
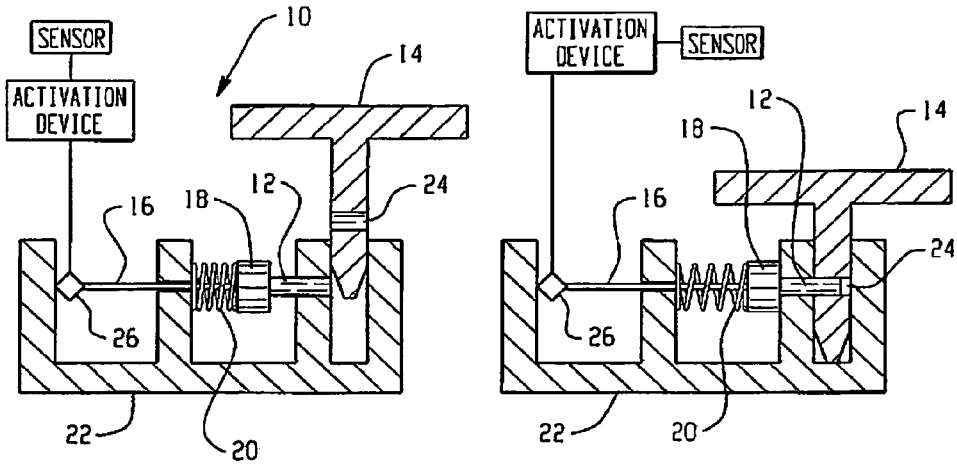
FIG. 1 is a schematic representation of a cross-section of a plunger latch in disengaged and engaged positions.

Methods and latch assemblies for reversible and on-demand lockdown of a hingeable hood to a vehicle body are disclosed herein. In contrast to the prior art, the methods and latches disclosed herein advantageously are based on active materials. As used herein, the term "hood" is synonymous with "closure" and generally refers to lids covering engine, storage compartments, or fuel tank areas as well as to vehicle doors for passenger entry into and out of the vehicle, lift gates, tail gates, sunroofs, cargo hatches, and the like. The term "vehicle body" as used herein generally refers to parts of the vehicle onto which the hood may be fastened and includes, among others, bumpers, fenders, chassis, frame and subframe components, and body panels. The term "active material" as used herein generally refers to a material that exhibits a change in a property such as dimension, shape, shear force, or flexural modulus upon application of an activation signal. Suitable active materials include, without limitation, shape memory alloys (SMA), ferromagnetic SMAs, shape memory polymers (SMP), piezoelectric materials, electroactive polymers (EAP), magnetorheological fluids and elastomers (MR), and electrorheological fluids (ER). Depending on the particular active material, the activation signal can take the form of, without limitation, an electric current, a temperature change, a magnetic field, a mechanical loading or stressing, or the like.

Also, as used herein, the terms "first", "second", and the like do not denote any order or importance, but rather are used to distinguish one element from another, and the terms "the", "a", and "an" do not denote a limitation of quantity, but rather denote the presence of at least one of the referenced item. Furthermore, all ranges disclosed herein are inclusive of the endpoints and independently combinable.

In one embodiment, the method reversible and on-demand lockdown of a hingeable hood to a vehicle body comprises producing the activation signal with an activation device, applying the activation signal to the active material, and engaging or disengaging the latch. Producing the activation signal may comprise sensing an impact event, manual activation by an occupant or a person servicing the vehicle, electronic activation of a built-in logic control system such as for example, activation of a vehicle stability enhancement system (VSES), turning on or off the ignition, and the like. Sensing the impact event may be accomplished with a pre-impact sensor or, alternatively, with an impact sensor.

In one embodiment, the latch comprises a pin, a gate, the active material, and the activation device. The pin may be disposed on the hingeable hood with the gate disposed on the vehicle body. Alternatively, the pin may be disposed on the vehicle body with the gate disposed on the hingeable hood. The pin and the gate are matingly engageable with each other and can be of any size, shape, or composition. The active material is in operative communication with either the pin or the gate and the activation device is in operative communication with the active material.

The activation device is operable to selectively apply the activation signal to the active material, which results in engagement or disengagement of the pin or the gate from the other of the pin or the gate. The activation signal provided by the activation device may include a heat signal, a magnetic signal, an electrical signal, a pneumatic signal, a mechanical signal, and the like, and combinations comprising at least one of the foregoing signals, with the particular activation signal dependent on the materials and/or configuration of the active material. For example, a magnetic and/or an electrical signal may be applied for changing the property of the active material fabricated from magnetostrictive materials. A heat signal may be applied for changing the property of the active material fabricated from shape memory alloys and/or shape memory polymers. An electrical signal may be applied for changing the property of the active material fabricated from electroactive materials, piezoelectrics, electrostatics, and/or ionic polymer metal composite materials.

Desirably, the change in the property of the active material remains for the duration of the applied activation signal. Also desirably, upon discontinuation of the activation signal, the property reverts substantially to its original form prior to the change.

Depending on the particular latch chosen, the active material may engage or disengage the latch through linear or rotary motion of the pin or gate. When engaged, the latch is in a locked position and the hingeable hood is secured to the vehicle body; when disengaged, the latch is in an unlocked position. When engaged, the latch is opposed to disengagement by a lifting force. Optionally, the hingeable hood may include a plurality of latches at various points about its perimeter, for example, thereby providing increased security, increased vehicle torsional stiffness, increased energy absorption in an impact event, and the like.

In some embodiments the lifting force is opposed by a physical obstruction, and the latch is termed an obstruction latch. Suitable obstruction latches include, without limitation, plunger latches, gravity gate latches, retractable fin latches, L-latches, three-point latches, swinging bar latches, T-latches, I-latches, and the like.

FIG. 1 depicts an exemplary plunger latch 10 in engaged and disengaged relationships. The gate 14 comprises a mating hole 24 engageable with pin 12. Pin 12 is disposed on a slider block 18, which includes an active material 16 and a spring 20 disposed on a side opposite pin 12. On a side opposite the slider block 18, active material 16 is coupled to and in operative communication with a connector 26. Connector 26 provides a means of attachment for active material 16 to a pin mount body 22 and to an activation device. Spring 20 exerts a pushing force on slider block 18, and pin 12, towards gate 14 such that pin 12 becomes engaged with gate 14 when mating hole 24 of gate 14 is aligned with pin 12. Under these circumstances the plunger latch is in a locked position.

Producing the activation signal with the activation device and applying the activation signal to active material 16 effects a change in the property of active material 16. When the change in the property is effected, active material 16 exerts a pulling force on slider block 18, which results in pin 12 retracting from mating hole 24 and spring 20 becoming compressed. Under these circumstances the plunger latch is no longer in a locked position, shown as disengaged plunger latch 10. For example, if the active material is a shape memory alloy, the activation signal may comprise a thermal signal, which causes contraction of the shape memory alloy, resulting in disengagement.

In another embodiment, spring 20 may be formed from an active material. The active material spring can be formed from the same or different active material used in active material 16.

Figure 2:
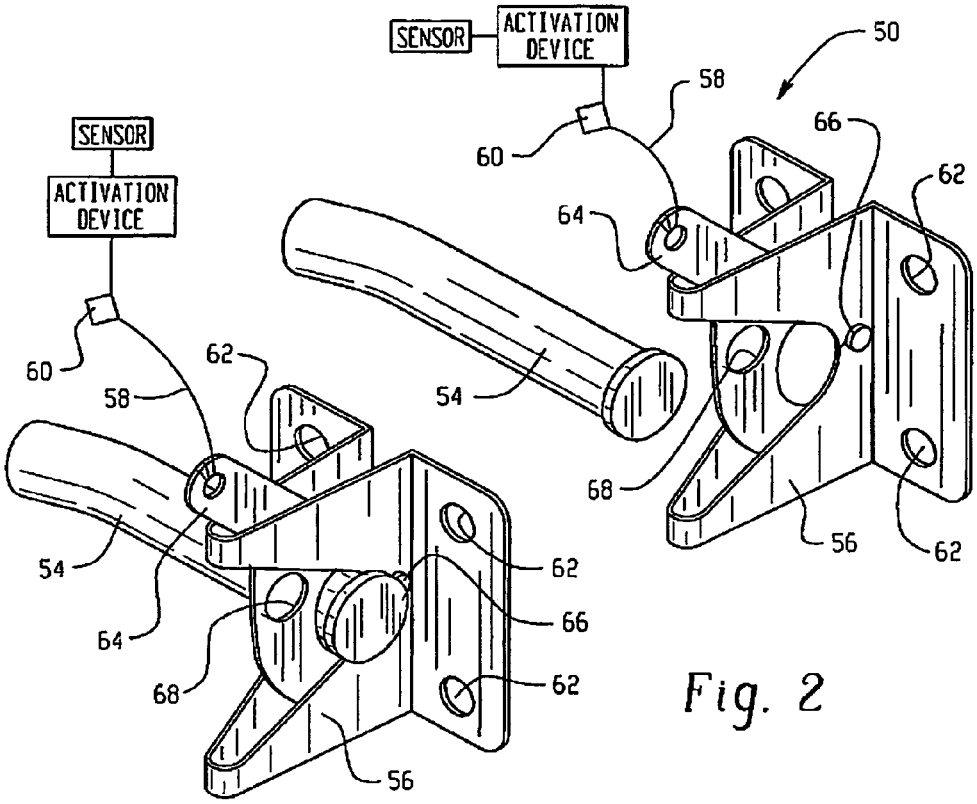
FIG. 2 is a schematic representation of a gravity gate latch in disengaged and engaged positions.

FIG. 2 depicts an exemplary gravity gate latch 50 in engaged and disengaged relationships. The gate 56 comprises mount points 62 and a gate lever 64, which is hingedly connected to gate 56 by a lever hinge 66. On one side, an active material 58 is coupled to and in operative communication with gate lever 64. On a side opposite the gate lever 64, active material 58 is coupled to and in operative communication with a connector 60, which provides a means of attachment for active material 58 to the activation device. Gate lever 64 may rotate about lever hinge 66 to an opened position to allow pin 54 to align with gate 56. When pin 54 and gate 56 are aligned, gate lever 64 may rotate to a closed position to engage pin 54 and gate 56. Under these circumstances the gravity gate latch is in a locked position. In one embodiment, gate lever 64 may be constructed of a material that is weighted such that it will not rotate to the opened position without the activation signal being produced. Alternatively, gate lever 64 may have a mount point 68 that provides a means of attachment for a counterbalance, pin, or spring (not shown), which may be used to further ensure that gate lever 64 will not freely rotate to the opened position.

Producing the activation signal with the activation device and applying the activation signal to active material 58 effects a change in the property of active material 58. When the change in the property is effected, active material 58 exerts a pulling force on gate lever 64, which results in gate lever 64 rotating about lever binge 66 to the opened position. Under these conditions pin 54 may freely disengage from gate 56 and the latch is no longer in a locked position.

Figure 3:
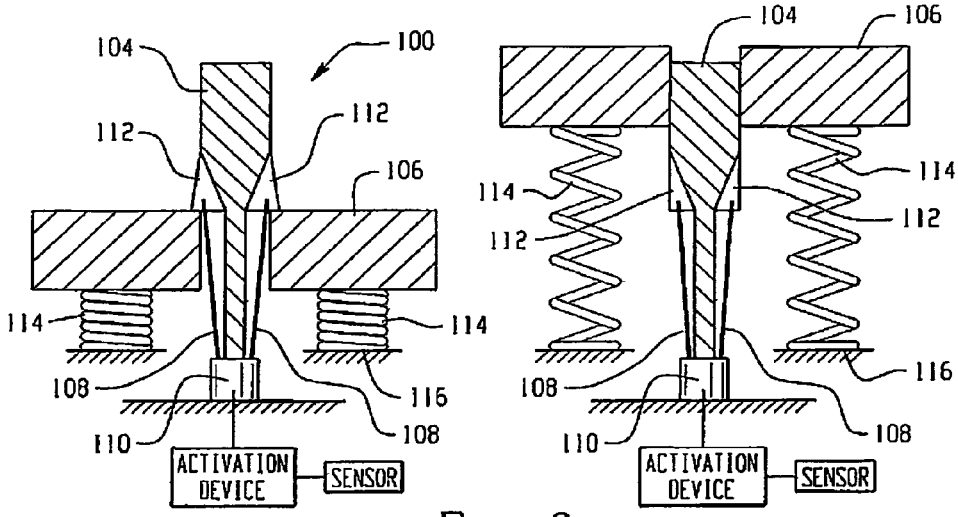
FIG. 3 is a schematic representation of a cross section of a retractable fin latch in disengaged and engaged positions.

FIG. 3 depicts an exemplary retractable fin latch 100 in engaged and disengaged relationships. The pin 104 comprises one or more flexible fins 112, which can refract. On one side, the active material 108 is coupled to and in operative communication with the one or more fins 112. On a side opposite the one or more fins 112, active material 108 is coupled to and in operative communication with a connector 110, which provides a means of attachment for active material 108 to the activation device. One or more springs 114 are disposed on one side of gate 116. On a side opposite gate 106, the one or more springs 114 are disposed on one or more gate mount bodies 116. The one or more springs 114 exert a pushing force on gate 106 such that when the one or more fins 112 of pin 104 are refracted, gate 106 is free to move in a direction parallel or anti-parallel to the pushing force. When pin 104 is in a position such that the one or more fins 112 of pin 104 are on a side opposite the side of gate 106 where the one or more springs 114 are disposed, and the one or more fins 112 are not retracted, the one or more springs 114 are compressed and the latch is in a locked position.

Producing the activation signal with the activation device and applying the activation signal to active material 108 effects a change in the property of active material 108. When the change in the property is effected, active material 108 causes the one or more fins 112 of pin 104 to retract, and gate 106, by virtue of the pushing force exerted by the compressed one or more springs 114, moves to disengage from pin 104. Under these circumstances the latch is no longer in a locked position.

Figure 4:
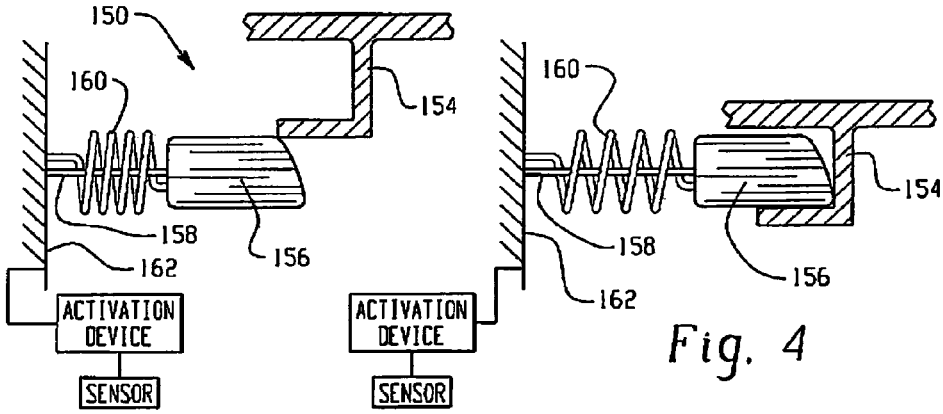
FIG. 4 is a schematic representation of a cross section of an L-latch in disengaged and engaged positions.

FIG. 4 depicts an exemplary L-latch 150 in engaged and disengaged relationships. Pin 156 is disposed on active material 158 and a spring 160. On a side opposite the pin 156, active material 158 and spring 160 are coupled to and in operative communication with a connector 162. Connector 162 provides a means of attachment for active material 158 to the activation device. Spring 160 exerts a pushing force on pin 156, towards gate 154 such that pin 156 becomes engaged with gate 154 when gate 154 is aligned with pin 156. Under these circumstances the latch is in a locked position.

Producing the activation signal with the activation device and applying the activation signal to active material 158 effects a change in the property of active material 158. When the change in the property is effected, active material 158 exerts a pulling force on pin 156, which results in pin 156 retracting from gate 154 and spring 160 becoming compressed. Under these circumstances the latch is no longer in a locked position.

In another embodiment, spring 160 may substitute for active material 158 and is formed from an active material. Alternatively, spring 160 may comprise an active material, which optionally is the same active material used in active material 158.

Figure 5:
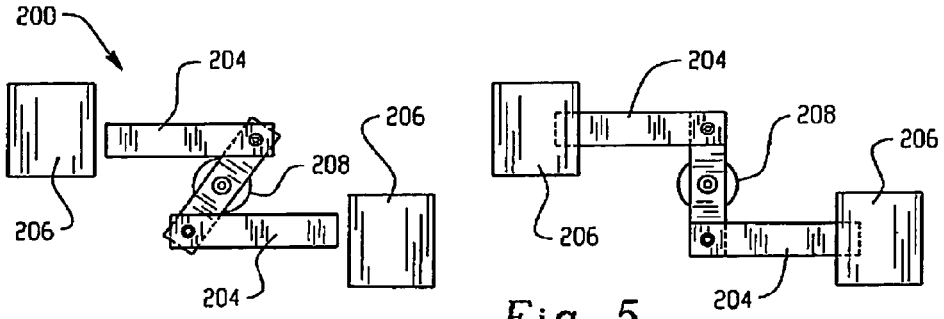
FIG. 5 is a schematic representation of a cross section of a three-point latch in disengaged and engaged positions.

FIG. 5 depicts an exemplary three-point latch 200 in engaged and disengaged relationships. In this type of latch, two pins 204 and two gates 206 are used. The two pins 204 are hingedly coupled to and in operative communication with a rotating pin hub 208. Pin hub 208 is coupled to and in operative communication with the active material (not shown). When pin hub 208 rotates in a counterclockwise (according to the figure) direction, pins 204 move to engage with gates 206. Under these circumstances the latch is in a locked position.

Producing the activation signal with the activation device (not shown) and applying the activation signal to the active material effects a change in the property of the active material. When the change in the property is effected, the active material rotates pin hub 208 clockwise (according to the figure) such that the pins 204 move to disengage with gates 206. Under these circumstances, the latch is no longer in a locked position.

Figure 6:
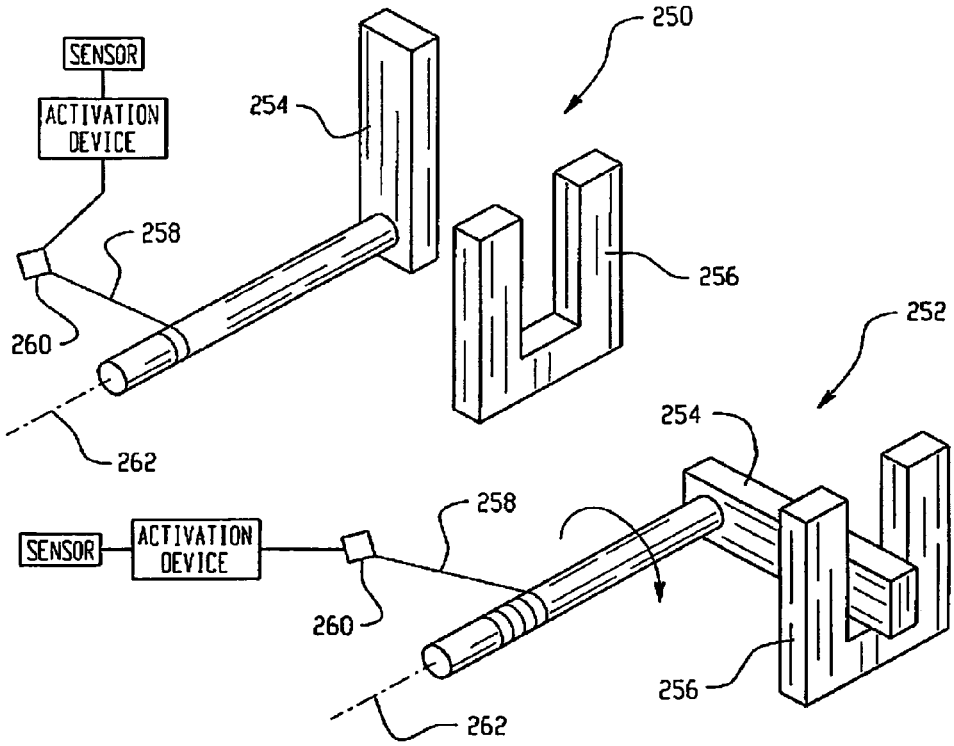
FIG. 6 is a schematic representation of a swinging bar latch in disengaged and engaged positions.

FIG. 6 depicts an exemplary swinging bar latch 250 in engaged and disengaged relationships. The C-shaped gate 256 is disposed on the vehicle body or the hood such that an opening in the C-shaped gate 256 is closed. The pin 254 is coupled to and in operative communication with the active material 258. On a side opposite pin 254, active material 258 is coupled to and in operative communication with a connector 260. Connector 260 provides a means of attachment for active material 258 to the activation device. When pin 254 rotates about a rotation axis 262 in a clockwise (according to the figure) direction, pin 254 may engage with gate 256. Under these circumstances the latch is in a locked position.

Producing the activation signal with the activation device and applying the activation signal to active material 258 effects a change in the property of the active material 258. When the change in the property is effected, the active material 258 rotates pin 254 counterclockwise (according to the figure) about rotation axis 262 such that pin 254 disengages with gate 256. Under these circumstances, the latch is no longer in a locked position.

Figure 7:
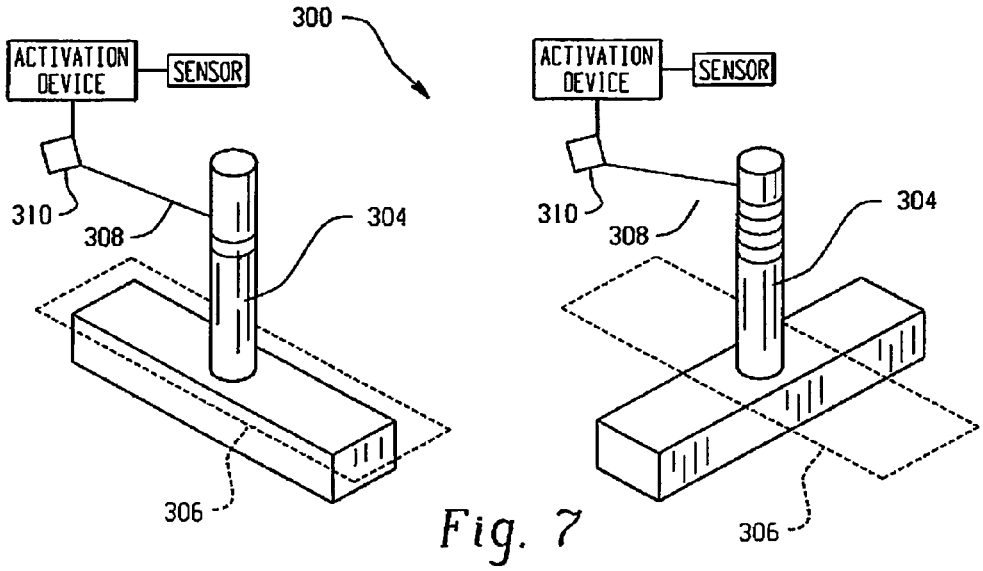
FIG. 7 is a schematic representation of a T-latch in disengaged and engaged positions.
Figure 8:
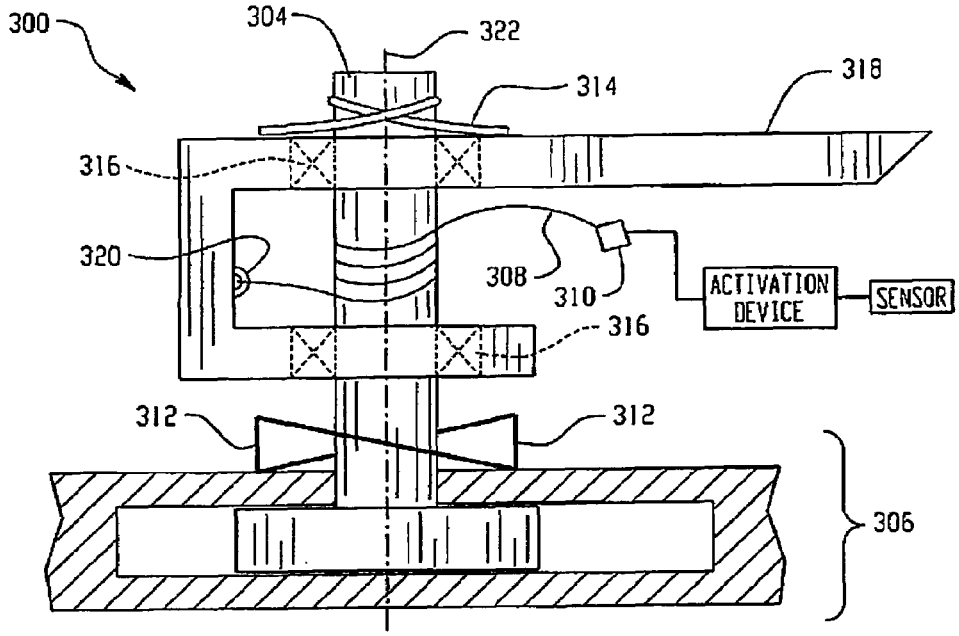
FIG. 8 is a schematic representation of a cross section of an engaged T-latch.

FIG. 7 depicts perspective views of an exemplary T-latch 300 in engaged and disengaged relationships. FIG. 8 depicts a cross sectional view. The gate 306 includes one or more pin guides 312, disposed near an entry point of gate 306, used to facilitate alignment and engagement of pin 304 with gate 306. The T-shaped pin 304 is coupled to and in operative communication with a pin body 318. Pin body 318 comprises one or more pin shaft bearings 316, one or more torsion springs 314, and an active material fasten point 320. The one or more pin shaft bearings 316 serve to facilitate rotation of pin 304 about a rotation axis 322. The one or more torsion springs 314 are disposed on pin body 318 and are in operative communication with pin 304. The one or more torsion springs 314 exert a rotational force on pin 304 wherein a rest position for pin 304 is similar to a position of pin 304 when the T-latch is engaged. The active material 308 is coupled to and in operative communication with pin 304.

On one side, active material 308 is fastened to active material fasten point 320. On a side opposite active material fasten point 320, active material 308 is coupled to and in operative communication with a connector 310. Connector 310 provides a means of attachment for active material 308 to the activation device.

When pin 304, along with pin body 318, is brought in proximity to the entry point of gate 306, the rest position of pin 304 does not permit alignment and engagement of pin 304 with gate 306. As pin 304 is brought into contact with the one or more pin guides 312, the one or more pin guides 312 exert a rotational force, opposite in direction of the rotational force exerted by the one or more torsion springs 314, on pin 304, which causes pin 304 to rotate about rotation axis 322 and align with the entry point of gate 306. Once an engageable part of pin 304 has cleared the entry point of gate 306, the rotational force exerted by the one or more torsion springs 314 causes pin 304 to rotate about rotation axis 322 to the rest position, which results in pin 304 being engaged with gate 306. Under these circumstances the latch is in a locked position.

Producing the activation signal with the activation device and applying the activation signal to active material 308 effects a change in the property of the active material 308. When the change in the property is effected, the active material 308 rotates pin 304 about rotation axis 322 such that pin 304 may disengage with gate 306. Under these circumstances, the latch is no longer in a locked position.

Figure 9:
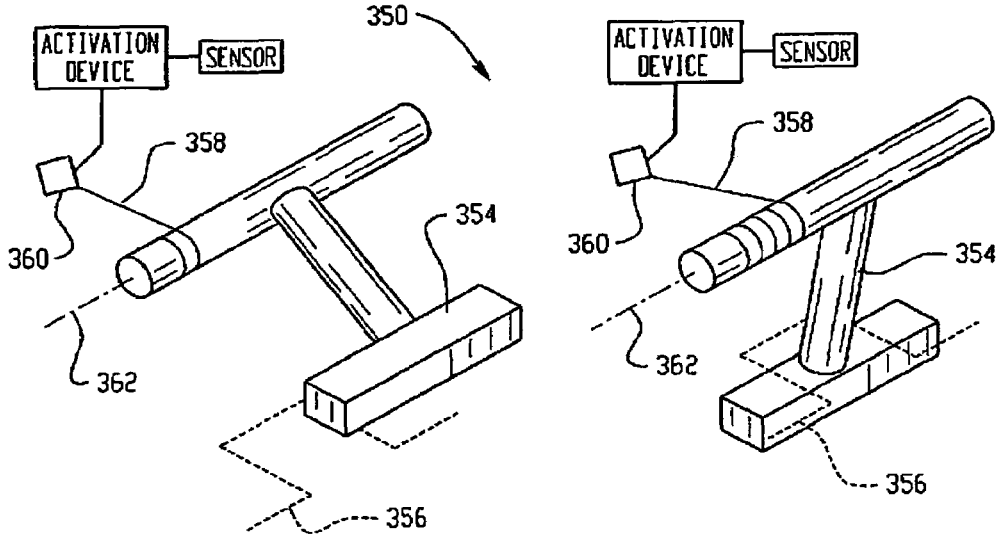
FIG. 9 is a schematic representation of an I-latch in disengaged and engaged positions.

FIG. 9 depicts an exemplary I-latch 350 in engaged and disengaged relationships. The pin 354 is coupled to and in operative communication with the active material 358. On a side opposite pin 354, active material 358 is coupled to and in operative communication with a connector 360. Connector 360 provides a means of attachment for active material 358 to the activation device. When pin 354 rotates about a rotation axis 362 in a clockwise (according to the figure) direction, pin 354 may engage with gate 356. The rotation about rotation axis 362 may be effected by manual or electromechanical means, or by operation of active material 358, which may be wrapped in a counter-opposing manner about rotation axis 362. Under these circumstances the latch is in a locked position.

Producing the activation signal with the activation device and applying the activation signal to active material 358 effects a change in the property of the active material 358. When the change in the property is effected, the active material 358 rotates pin 354 counterclockwise (according to the figure) about rotation axis 362 such that pin 354 disengages with gate 356. Under these circumstances, the latch is no longer in a locked position.

In other embodiments, a frictional force imposed between a surface of the pin and a surface of the gate opposes the lifting force, and the latch is termed a frictional latch. Suitable frictional latches include, without limitation, burr latches, tooth latches, bump latches, and the like.

Figure 10:
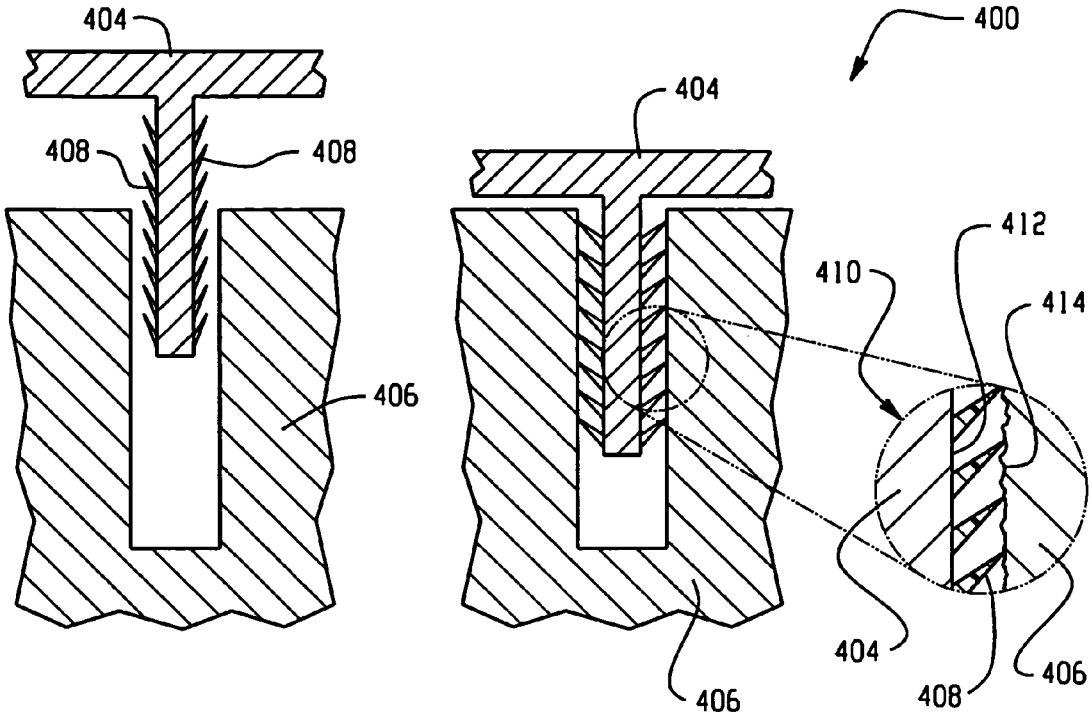
FIG. 10 is a schematic representation of a cross section of a burr latch in disengaged and engaged positions.

FIG. 10 depicts an exemplary burr latch 400 in engaged and disengaged relationships. One or more burrs 408 are disposed on a surface of the pin 404. The one or more burrs 408 comprise the active material. In one embodiment, the one or more burrs 408 comprise a two-way SMA. A rest position for the one or more burrs 408 is such that the one or more burrs 408 extend from a pin surface 412 either perpendicular to, or angled away from, pin surface 412. When pin 404 is aligned with gate 406 and the one or more burrs 408 are in the rest position, pin 404 may engage with gate 406, wherein the one or more burrs 408 are rotated and extended upward as it engages. Under these circumstances, the latch is in a locked position. As seen in an enlargement 410, the one or more burrs 408, which extend from pin surface 412 interact, and optionally bind, with a gate surface 414 to provide the frictional force, which opposes the lifting force.

Producing the activation signal with the activation device (not shown) and applying the activation signal to active material effects a change in the property of the active material. The change in the property results in the one or more burrs 408 retracting away from gate surface 414 and towards pin surface 412 so as to lie in close proximity to pin surface 412. Under these circumstances, the latch 400 is no longer in a locked position. Subsequent to this, termination of the activation signal results in the one or more burrs 408 to return to the rest position.

Figure 11:
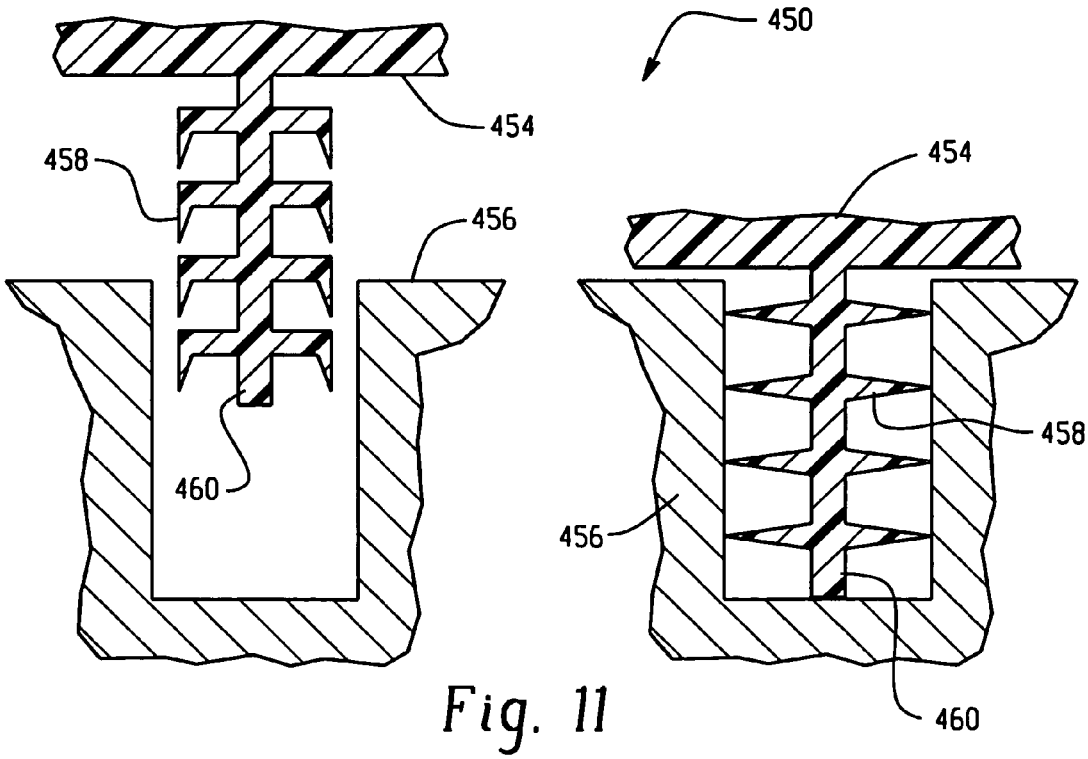
FIG. 11 is a schematic representation of a cross section of a tooth latch in disengaged and engaged positions.

FIG. 11 depicts an exemplary tooth latch 450 in engaged and disengaged relationships. The pin 454 includes one or more teeth 458, which protrude from a pin shaft 460. The one or more teeth 458 comprise the active material. In one exemplary embodiment, the one or more teeth 458 comprise a two-way SMA. Tips of the one or more teeth 458 are bent downwards in an original condition, which allows insertion of pin 454 in gate 456. When pin 454 within the gate 456, producing the activation signal with the activation device (not shown) and applying the activation signal to the active material effects a change in the property of the active material. Discontinuing the activation signal results in the property to revert back to the original condition, and the one or more teeth 458 retract away from gate 456 and towards pin shaft 460. Under these circumstances, the latch 450 is no longer in a locked position.

Figure 12:
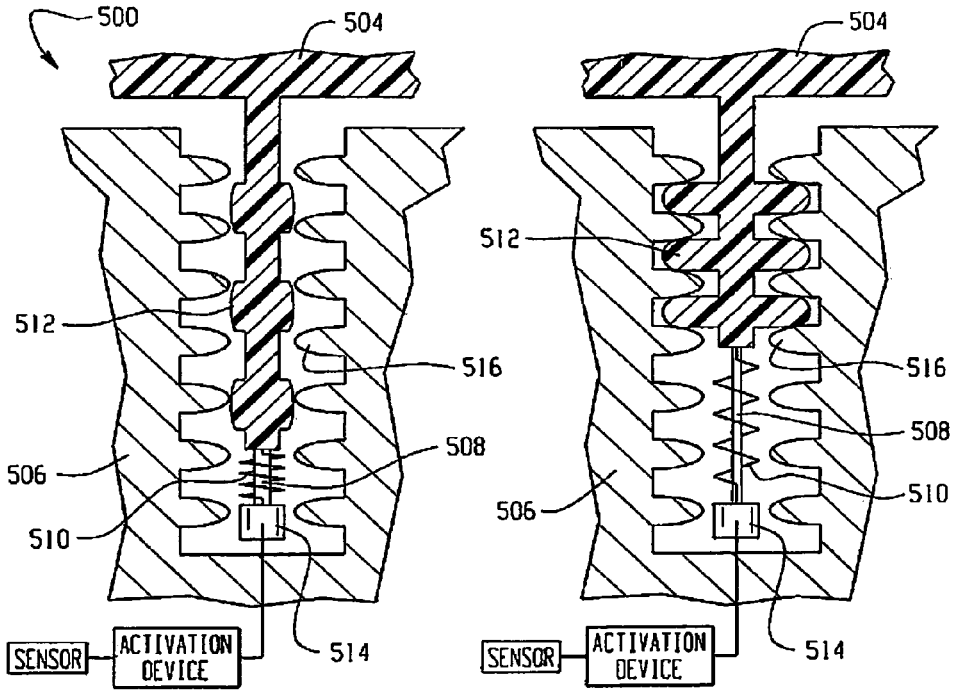
FIG. 12 is a schematic representation of a cross section of a bump latch in disengaged and engaged positions.

FIG. 12 depicts an exemplary bump latch 500 in engaged and disengaged relationships. The gate 506 comprises one or more protruding gate bumps 516. The pin 504 comprises one or more protruding pin bumps 512 engageable with the one or more protruding gate bumps 516. The pin 504 and the one or more protruding pin bumps 512 may optionally comprise active materials. A spring 510 and the active material 508 are coupled to and in operative communication with pin 504. On a side opposite pin 504, spring 510 and active material 508 are coupled to an in operative communication with a connector 514. Connector 514 provides a means of attachment for active material 516 to the activation device and may serve as a spring stop. In one embodiment, active material 508 comprises a one-way SMA, wherein activating active material 508 extends pin 504 and collapses the one or more protruding pin bumps 512 effective to insert pin 504 into gate 506. When pin 504 is aligned with gate 506, the activating signal may be discontinued, such that spring 510 extends/pin 504 shortens, and in doing so the one or more protruding pin bumps 512 extend. The one or more protruding pin bumps 512 are then fully extended, perpendicular to a long axis of pin 504, such that each of the one or more protruding pin bumps 512 are interposed between the one or more protruding gate bumps 516, pin 504 may engage with gate 506. Under these circumstances, the latch is in a locked position.

Producing the activation signal with the activation device and applying the activation signal to the active material 508, and to the optional active material of the pin 504, effects a change in the property of the active material 508, and the optional active material of the pin 504. When the change in the property is effected, pin 504 is extended and the one or more protruding pin bumps 512 collapse away from the one or more protruding gate bumps 516. Under these circumstances, the latch is no longer in a locked position. In another embodiment, the bumps may comprise an SMP, and may be softened and hardened, respectively, by turning off and on the activation signal.

In other embodiments, the lifting force is opposed by an interference fit between the pin and the gate, and the latch is termed an interference latch. Suitable interference latches include, without limitation, split-gate jam latches, expanding-gate jam latches, and the like.

Figure 13:
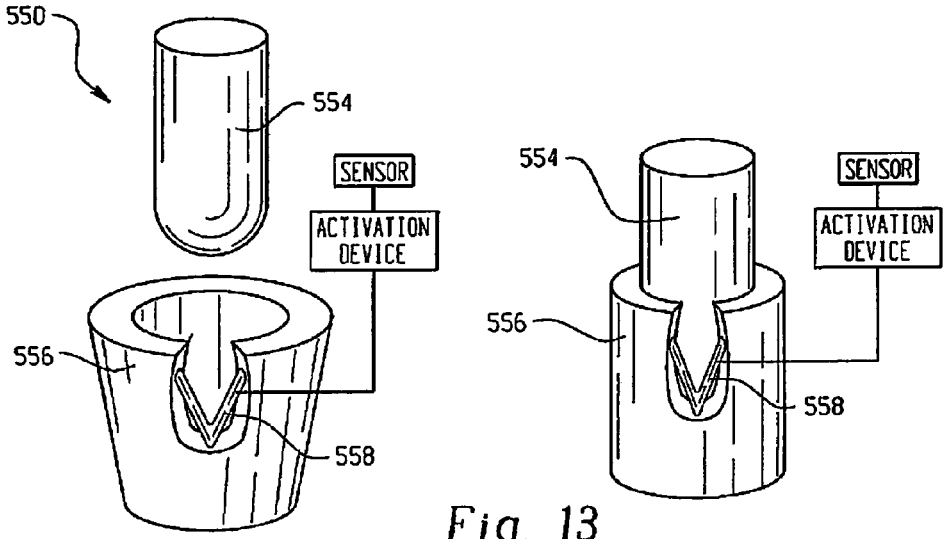
FIG. 13 is a schematic representation of a split-gate jam latch in disengaged and engaged positions.

FIG. 13 depicts an exemplary split-gate jam latch 550 in engaged and disengaged relationships. The gate 556 is a tubular shaped cylinder with a "U"-shaped slot on a wall. A diameter of pin 554 is slightly larger than a diameter of gate 556. The active material 558 is disposed in and in operative communication with the "U"-shaped slot on the wall of gate 556. When pin 554 is inserted into gate 556, gate 556 deforms slightly to allow insertion, and an interference fit is formed owing to a difference in diameters. Under these circumstances, the latch is in a locked position.

Producing the activation signal with the activation device and applying the activation signal to the active material 558 effects a change in the property of the active material 558. When the change in the property is effected, the "U"-shaped slot on the wall of gate 556 expands causing the diameter of gate 556 to increase such that pin 554 is no longer engaged with gate 556. Under these circumstances, the latch is no longer in a locked position.

Figure 14:
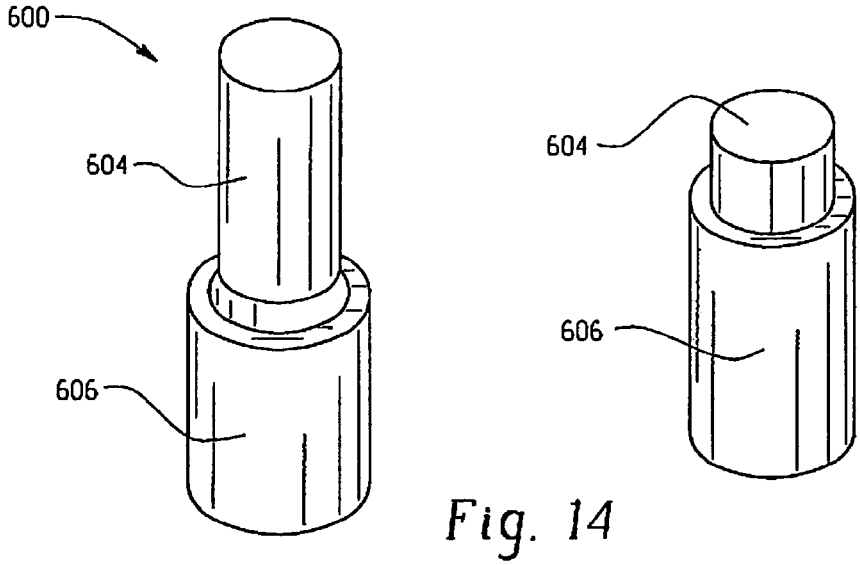
FIG. 14 is a schematic representation of an expanding-gate jam latch in disengaged and engaged positions.

FIG. 14 depicts an exemplary expanding-gate jam latch 600 in engaged and disengaged relationships. The gate 606 is a tubular shaped cylinder and comprises the active material. A diameter of pin 604 is slightly larger than a diameter of gate 606. To insert pin 604, the active material is activated, expanding gate 606 allowing pin 604 insertion. The activation signal may be turned off, contracting gate 606, and an interference fit is formed. Under these circumstances, the latch is in a locked position.

Producing the activation signal with the activation device (not shown) and applying the activation signal to the active material effects a change in the property of the active material. When the change in the property is effected, gate 606 expands such that pin 604 is no longer engaged with gate 606. Under these circumstances, the latch is no longer in a locked position.

In other embodiments, the lifting force is opposed by a pressure force in a chamber of the pin or the gate, and the latch is a pressure latch. Suitable pressure latches include, without limitation, active pore latches, air latches, active fluid latches, and the like.

Figure 15:
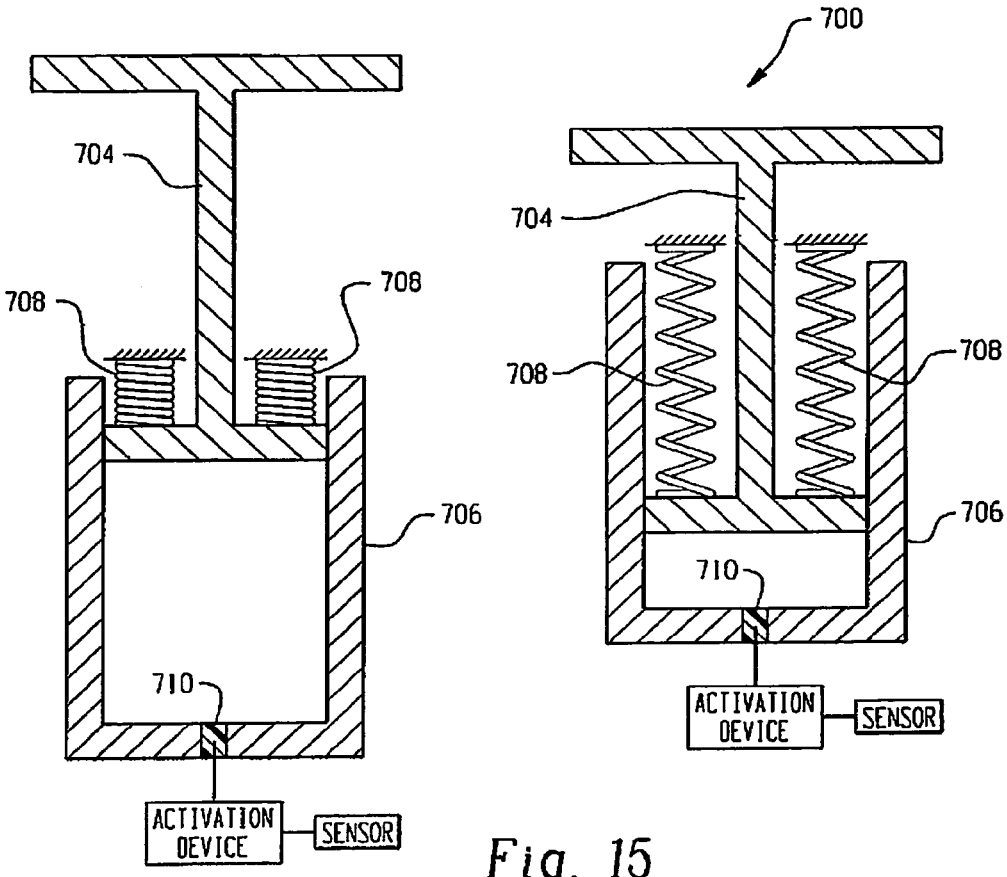
FIG. 15 is a schematic representation of a cross section of an active pore latch in disengaged and engaged positions.

FIG. 15 depicts an exemplary active pore latch 700 in engaged and disengaged relationships. The pin 704 and gate 706 function as a piston and cylinder, respectively. Pin 704 optionally includes one or more springs 708, disposed on pin 704, which may facilitate engagement and disengagement of pin 704 from gate 706. The one or more springs 708 may comprise an active material. Gate 706 includes the active material in the form of an active pore 710. When pin 704 is aligned with, and inserted into gate 706, the active pore 710 must be open to allow any air within the cylinder to evacuate. Alternatively, the air within the cylinder may be evacuated by a pump (not shown). As pin 704 moves further into gate 706, the optional one or more springs 708 become stretched. Once pin 704 is engaged with gate 706, active pore 710 closes. Under these circumstances, the latch is in a locked position. Disengagement of pin 704 from gate 706 is resisted by a pressure differential between external air and the pressure force in the evacuated cylinder.

Producing the activation signal with the activation device and applying the activation signal to active pore 710 effects a change in the property of active pore 710. When the change in the property is effected, active pore 710 opens to enable air into the cylinder such that pin 704 may disengage from gate 706. Furthermore, the optional one or more springs 708 exert a pulling force on pin 704 to facilitate disengagement. Under these circumstances, the latch is no longer in a locked position.

Figure 16:
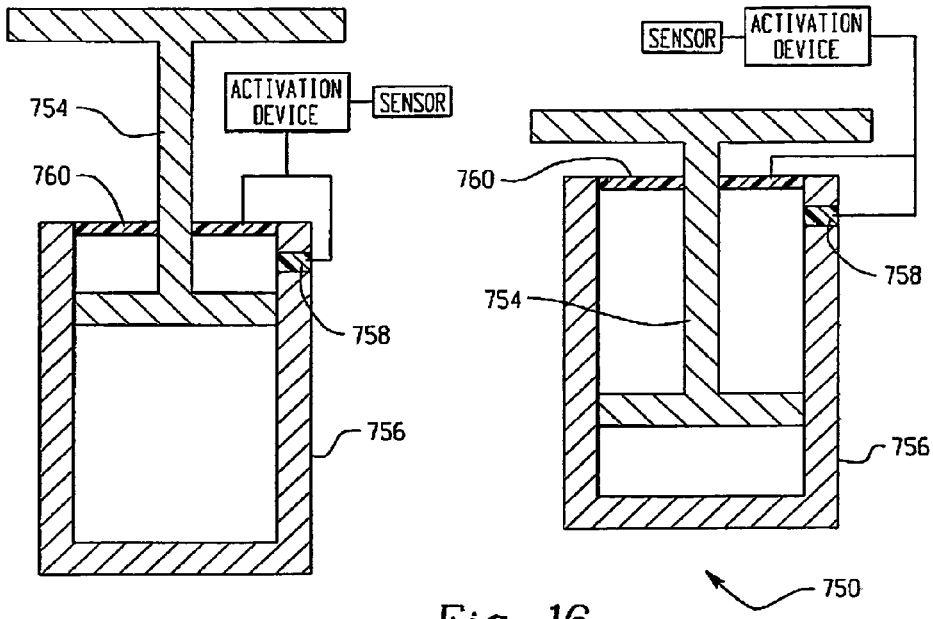
FIG. 16 is a schematic representation of a cross section of an air latch in disengaged and engaged positions.

FIG. 16 depicts an exemplary air latch 750 in engaged and disengaged relationships. The pin 754 and gate 756 function as a piston and cylinder, respectively. The active material, in the form of an active seal 760 is coupled to and in slideable communication with pin 754. Gate 756 includes another active material in the form of an active pore 758. When pin 754 is aligned with, and inserted into gate 706, active seal 760 becomes interposed between any walls of the cylinder. The active pore 758 must be open to allow air to enter an area between the active seal 760 and the bottom of pin 754. Alternatively, air may be pumped into the area between the active seal 760 and the bottom of pin 754 using a pump (not shown). Any air between the bottom of pin 754 and a cylinder bottom is compressed as pin 754 is further inserted into gate 756. Once pin 754 is engaged with gate 756, active pore 758 closes. Under these circumstances, the latch is in a locked position. Disengagement of pin 754 from gate 756 is resisted by the pressure force in the cylinder.

Producing the activation signal with the activation device and applying the activation signal to active pore 758 effects a change in the property of active pore 758. When the change in the property is effected, active pore 758 opens to enable air in the cylinder to evacuate such that pin 754 may disengage from gate 766. Disengagement is facilitated by a desire to achieve pressure equilibrium within the cylinder. Under these circumstances, the latch is no longer in a locked position.

Figure 17:
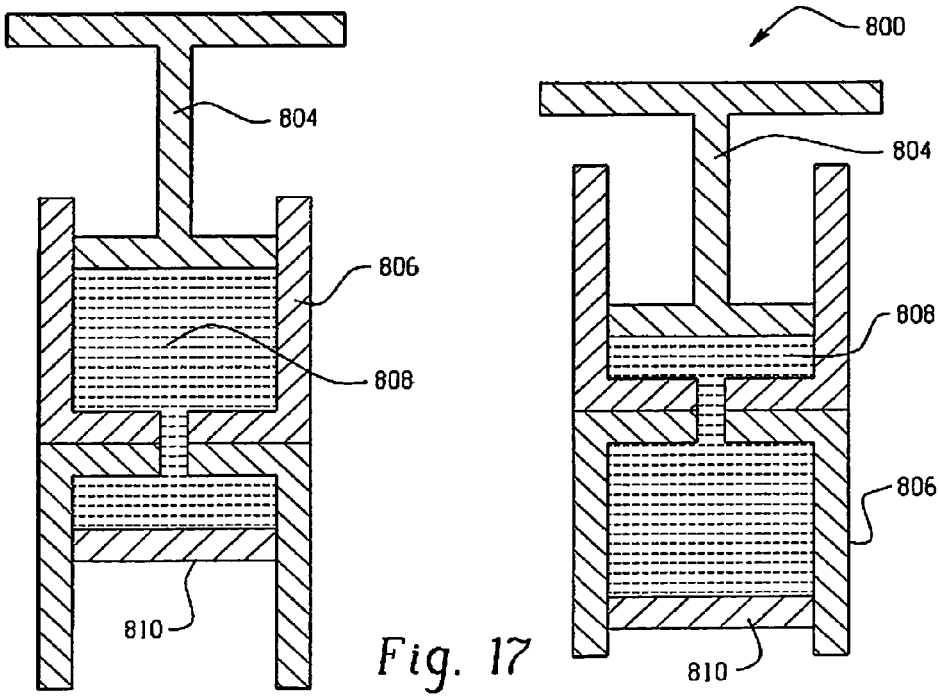
FIG. 17 is a schematic representation of a cross section of an active fluid latch.

FIG. 17 depicts an exemplary active fluid latch 800 in engaged and disengaged relationships. The pin 804 and gate 806 function as a piston and cylinder, respectively. Gate 806 comprises two cylinder chambers in fluid communication with each other by an opening in a common wall. A first cylinder chamber is sealed by pin 804 and a second cylinder chamber is sealed by moveable seal 810. The active material, in the form of an active fluid 808, is disposed in the two cylinder chambers between pin 804 and moveable seal 810. In this particular embodiment, pin 804 cannot be fully removed from gate 806. When pin 804 is further pushed into gate 806, active fluid 808 flows from the first cylinder chamber into the second cylinder chamber. Once pin 804 is effectively engaged with gate 806, a magnetic or electric field is applied to solidify active fluid 808. Under these circumstances, the latch is in a locked position.

Producing the activation signal (i.e., removal of the applied field) with the activation device (not shown) and applying the activation signal to active fluid 808 effects a change in the property of active fluid 808. The change in the property of active fluid 808 causes a transformation of solidified active fluid 808 to freely flowing active fluid 808 such that pin 804 may effectively disengage from gate 806. Under these circumstances, the latch is no longer in a locked position.

The latches shown in FIGS. 1-17 are exemplary only and are not intended to be limited to any particular shape, size, configuration, material composition, or the like. Although the latches described resulted in a disengaged latch upon application of the activation signal, other embodiments include engaged latches resulting upon application of the activation signal. One latch may be implemented so as to provide a single discrete attachment means of the hingeable hood to the vehicle body or more than one latch of one or more types may be implemented to provide a plurality of attachment means. One or more latches described herein may be used alone or in addition to a conventional latch assembly for lockdown of the hingeable hood to the vehicle body.

As previously described, suitable active materials include, without limitation, shape memory alloys (SMA), shape memory polymers (SMP), piezoelectric materials, electroactive polymers (EAP), ferromagnetic materials, magnetorheological fluids and elastomers (MR) and electrorheological fluids (ER).

Suitable shape memory alloys can exhibit a one-way shape memory effect, an intrinsic two-way effect, or an extrinsic two-way shape memory effect depending on the alloy composition and processing history. The two phases that occur in shape memory alloys are often referred to as martensite and austenite phases. The martensite phase is a relatively soft and easily deformable phase of the shape memory alloys, which generally exists at lower temperatures. The austenite phase, the stronger phase of shape memory alloys, occurs at higher temperatures. Shape memory materials formed from shape memory alloy compositions that exhibit one-way shape memory effects do not automatically reform, and depending on the shape memory material design, will likely require an external mechanical force to reform the shape orientation that was previously exhibited. Shape memory materials that exhibit an intrinsic shape memory effect are fabricated from a shape memory alloy composition that will automatically reform themselves.

The temperature at which the shape memory alloy remembers its high temperature form when heated can be adjusted by slight changes in the composition of the alloy and through heat treatment. In nickel-titanium shape memory alloys, for example, it can be changed from above about 100° C. to below about −100° C. The shape recovery process occurs over a range of just a few degrees and the start or finish of the transformation can be controlled to within a degree or two depending on the desired application and alloy composition. The mechanical properties of the shape memory alloy vary greatly over the temperature range spanning their transformation, typically providing the shape memory material with shape memory effects as well as high damping capacity. The inherent high damping capacity of the shape memory alloys can be used to further increase the energy absorbing properties.

Suitable shape memory alloy materials include without limitation nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the alloy composition exhibits a shape memory effect, e.g., change in shape orientation, damping capacity, and the like. For example, a nickel-titanium based alloy is commercially available under the trademark NITINOL from Shape Memory Applications, Inc.

Other suitable active materials are shape memory polymers. Similar to the behavior of a shape memory alloy, when the temperature is raised through its transition temperature, the shape memory polymer also undergoes a change in shape orientation. To set the permanent shape of the shape memory polymer, the polymer must be at about or above the Tg or melting point of the hard segment of the polymer. "Segment" refers to a block or sequence of polymer forming part of the shape memory polymer. The shape memory polymers are shaped at the temperature with an applied force followed by cooling to set the permanent shape. The temperature necessary to set the permanent shape is preferably between about 100° C. to about 300° C. Setting the temporary shape of the shape memory polymer requires the shape memory polymer material to be brought to a temperature at or above the Tg or transition temperature of the soft segment, but below the Tg or melting point of the hard segment. At the soft segment transition temperature (also termed "first transition temperature"), the temporary shape of the shape memory polymer is set followed by cooling of the shape memory polymer to lock in the temporary shape. The temporary shape is maintained as long as it remains below the soft segment transition temperature. The permanent shape is regained when the shape memory polymer fibers are once again brought to or above the transition temperature of the soft segment. Repeating the heating, shaping, and cooling steps can reset the temporary shape. The soft segment transition temperature can be chosen for a particular application by modifying the structure and composition of the polymer. Transition temperatures of the soft segment range from about −63° C. to above about 120° C.

Shape memory polymers may contain more than two transition temperatures. A shape memory polymer composition comprising a hard segment and two soft segments can have three transition temperatures: the highest transition temperature for the hard segment and a transition temperature for each soft segment.

Most shape memory polymers exhibit a "one-way" effect, wherein the shape memory polymer exhibits one permanent shape. Upon heating the shape memory polymer above the first transition temperature, the permanent shape is achieved and the shape will not revert back to the temporary shape without the use of outside forces. As an alternative, some shape memory polymer compositions can be prepared to exhibit a "two-way" effect. These systems consist of at least two polymer components. For example, one component could be a first cross-linked polymer while the other component is a different cross-linked polymer. The components are combined by layer techniques, or are interpenetrating networks, wherein two components are cross-linked but not to each other. By changing the temperature, the shape memory polymer changes its shape in the direction of the first permanent shape of the second permanent shape. Each of the permanent shapes belongs to one component of the shape memory polymer. The two permanent shapes are always in equilibrium between both shapes. The temperature dependence of the shape is caused by the fact that the mechanical properties of one component ("component A") are almost independent from the temperature in the temperature interval of interest. The mechanical properties of the other component ("component B") depend on the temperature. In one embodiment, component B becomes stronger at low temperatures compared to component A, while component B becomes stronger at low temperatures compared to component A, while component A is stronger at high temperatures and determines the actual shape. A two-way memory device can be prepared by setting the permanent shape of component A ("first permanent shape"); deforming the device into the permanent shape of component B ("second permanent shape") and fixing the permanent shape of component B while applying a stress to the component.

Similar to the shape memory alloy materials, the shape memory polymers can be configured in many different forms and shapes. The temperature needed for permanent shape recovery can be set at any temperature between about −63° C. and about 120° C. or above. Engineering the composition and structure of the polymer itself can allow for the choice of a particular temperature for a desired application. A preferred temperature for shape recovery is greater than or equal to about −30° C., more preferably greater than or equal to about 0° C., and most preferably a temperature greater than or equal to about 50° C. Also, a preferred temperature for shape recovery is less than or equal to about 120° C., more preferably less than or equal to about 90° C., and most preferably less than or equal to about 70° C.

Suitable shape memory polymers include thermoplastics, thermosets, interpenetrating networks, semi-interpenetrating networks, or mixed networks. The polymers can be a single polymer or a blend of polymers. The polymers can be linear or branched thermoplastic elastomers with side chains or dendritic structural elements. Suitable polymer components to form a shape memory polymer include, but are not limited to, polyphosphazenes, poly(vinyl alcohols), polyamides, polyester amides, poly(amino acid)s, polyanhydrides, polycarbonates, polyacrylates, polyalkylenes, polyacrylamides, polyalkylene glycols, polyalkylene oxides, polyalkylene terephthalates, polyortho esters, polyvinyl ethers, polyvinyl esters, polyvinyl halides, polyesters, polylactides, polyglycolides, polysiloxanes, polyurethanes, polyethers, polyether amides, polyether esters, and copolymers thereof. Examples of suitable polyacrylates include poly(methyl methacrylate), poly(ethyl methacrylate), ply(butyl methacrylate), poly (isobutyl methacrylate), poly(hexyl methacrylate), poly(isodecyl methacrylate), poly(lauryl methacrylate), poly(phenyl methacrylate), poly(methyl acrylate), poly(isopropyl acrylate), poly(isobutyl acrylate) and poly(octadecyl acrylate). Examples of other suitable polymers include polystyrene, polypropylene, polyvinyl phenol, polyvinylpyrrolidone, chlorinated polybutylene, poly(octadecyl vinyl ether) ethylene vinyl acetate, polyethylene, poly(ethylene oxide)-poly (ethylene terephthalate), polyethylene/nylon (graft copolymer), polycaprolactones-polyamide (block copolymer), poly (caprolactone) dimethacrylate-n-butyl acrylate, poly (norbornyl-polyhedral oligomeric silsequioxane), polyvinylchloride, urethane/butadiene copolymers, polyurethane block copolymers, styrene-butadiene-styrene block copolymers, and the like.

The shape memory polymer or the shape memory alloy, may be activated by any suitable means, preferably a means for subjecting the material to a temperature change above, or below, a transition temperature. For example, for elevated temperatures, heat may be supplied using hot gas (e.g., air), steam, hot liquid, or electrical current. The activation means may, for example, be in the form of heat conduction from a heated element in contact with the shape memory material, heat convection from a heated conduit in proximity to the thermally active shape memory material, a hot air blower or jet, microwave interaction, resistive heating, and the like. In the case of a temperature drop, heat may be extracted by using cold gas, or evaporation of a refrigerant. The activation means may, for example, be in the form of a cool room or enclosure, a cooling probe having a cooled tip, a control signal to a thermoelectric unit, a cold air blower or jet, or means for introducing a refrigerant (such as liquid nitrogen) to at least the vicinity of the shape memory material.

Suitable magnetic materials include, but are not intended to be limited to, soft or hard magnets; hematite; magnetite; magnetic material based on iron, nickel, and cobalt, alloys of the foregoing, or combinations comprising at least one of the foregoing, and the like. Alloys of iron, nickel and/or cobalt, can comprise aluminum, silicon, cobalt, nickel, vanadium, molybdenum, chromium, tungsten, manganese and/or copper.

Suitable MR fluid materials include, but are not intended to be limited to, ferromagnetic or paramagnetic particles dispersed in a carrier fluid. Suitable particles include iron; iron alloys, such as those including aluminum, silicon, cobalt, nickel, vanadium, molybdenum, chromium, tungsten, manganese and/or copper; iron oxides, including $Fe_2O_3$ and $Fe_3O_4$; iron nitride; iron carbide; carbonyl iron; nickel and alloys of nickel; cobalt and alloys of cobalt; chromium dioxide; stainless steel; silicon steel; and the like. Examples of suitable particles include straight iron powders, reduced iron powders, iron oxide powder/straight iron powder mixtures and iron oxide powder/reduced iron powder mixtures. A preferred magnetic-responsive particulate is carbonyl iron, preferably, reduced carbonyl iron.

The particle size should be selected so that the particles exhibit multi-domain characteristics when subjected to a magnetic field. Average dimension sizes for the particles can be less than or equal to about 1000 micrometers, with less than or equal to about 500 micrometers preferred, and less than or equal to about 100 micrometers more preferred. Also preferred is a particle dimension of greater than or equal to about 0.1 micrometer, with greater than or equal to about 0.5 more preferred, and greater than or equal to about 10 micrometers especially preferred. The particles are preferably present in an amount between about 5.0 to about 50 percent by volume of the total MR fluid composition.

Suitable carrier fluids include organic liquids, especially non-polar organic liquids. Examples include, but are not limited to, silicone oils; mineral oils; paraffin oils; silicone copolymers; white oils; hydraulic oils; transformer oils; halogenated organic liquids, such as chlorinated hydrocarbons, halogenated paraffins, perfluorinated polyethers and fluorinated hydrocarbons; diesters; polyoxyalkylenes; fluorinated silicones; cyanoalkyl siloxanes; glycols; synthetic hydrocarbon oils, including both unsaturated and saturated; and combinations comprising at least one of the foregoing fluids.

The viscosity of the carrier component can be less than or equal to about 100,000 centipoise, with less than or equal to about 10,000 centipoise preferred, and less than or equal to about 1,000 centipoise more preferred. Also preferred is a viscosity of greater than or equal to about 1 centipoise, with greater than or equal to about 250 centipoise preferred, and greater than or equal to about 500 centipoise especially preferred.

Aqueous carrier fluids may also be used, especially those comprising hydrophilic mineral clays such as bentonite or hectorite. The aqueous carrier fluid may comprise water or water comprising a small amount of polar, water-miscible organic solvents such as methanol, ethanol, propanol, dimethyl sulfoxide, dimethyl formamide, ethylene carbonate, propylene carbonate, acetone, tetrahydrofuran, diethyl ether, ethylene glycol, propylene glycol, and the like. The amount of polar organic solvents is less than or equal to about 5.0% by volume of the total MR fluid, and preferably less than or equal to about 3.0%. Also, the amount of polar organic solvents is preferably greater than or equal to about 0.1%, and more preferably greater than or equal to about 1.0% by volume of the total MR fluid. The pH of the aqueous carrier fluid is preferably less than or equal to about 13, and preferably less than or equal to about 9.0. Also, the pH of the aqueous carrier fluid is greater than or equal to about 5.0, and preferably greater than or equal to about 8.0.

Natural or synthetic bentonite or hectorite may be used. The amount of bentonite or hectorite in the MR fluid is less than or equal to about 10 percent by weight of the total MR fluid, preferably less than or equal to about 8.0 percent by weight, and more preferably less than or equal to about 6.0 percent by weight. Preferably, the bentonite or hectorite is present in greater than or equal to about 0.1 percent by weight, more preferably greater than or equal to about 1.0 percent by weight, and especially preferred greater than or equal to about 2.0 percent by weight of the total MR fluid.

Optional components in the MR fluid include clays, organoclays, carboxylate soaps, dispersants, corrosion inhibitors, lubricants, extreme pressure anti-wear additives, antioxidants, thixotropic agents and conventional suspension agents. Carboxylate soaps include ferrous oleate, ferrous naphthenate, ferrous stearate, aluminum di- and tri-stearate, lithium stearate, calcium stearate, zinc stearate and sodium stearate, and surfactants such as sulfonates, phosphate esters, stearic acid, glycerol monooleate, sorbitan sesquioleate, laurates, fatty acids, fatty alcohols, fluoroaliphatic polymeric esters, and titanate, aluminate and zirconate coupling agents and the like. Polyalkylene diols, such as polyethylene glycol, and partially esterified polyols can also be included.

Suitable MR elastomer materials include, but are not intended to be limited to, an elastic polymer matrix comprising a suspension of ferromagnetic or paramagnetic particles, wherein the particles are described above. Suitable polymer matrices include, but are not limited to, poly-alpha-olefins, natural rubber, silicone, polybutadiene, polyethylene, polyisoprene, and the like.

Electroactive polymers include those polymeric materials that exhibit piezoelectric, pyroelectric, or electrostrictive properties in response to electrical or mechanical fields. The materials generally employ the use of compliant electrodes that enable polymer films to expand or contract in the in-plane directions in response to applied electric fields or mechanical stresses. An example of an electrostrictive-grafted elastomer with a piezoelectric poly(vinylidene fluoride-trifluoro-ethylene) copolymer. This combination has the ability to produce a varied amount of ferroelectric-electrostrictive molecular composite systems. These may be operated as a piezoelectric sensor or even an electrostrictive actuator. Activation of an EAP based pad preferably utilizes an electrical signal to provide change in shape orientation sufficient to provide displacement. Reversing the polarity of the applied voltage to the EAP can provide a reversible lockdown mechanism.

Materials suitable for use as the electroactive polymer may include any substantially insulating polymer or rubber (or combination thereof) that deforms in response to an electrostatic force or whose deformation results in a change in electric field. Exemplary materials suitable for use as a pre-strained polymer include silicone elastomers, acrylic elastomers, polyurethanes, thermoplastic elastomers, copolymers comprising PVDF, pressure-sensitive adhesives, fluoroelastomers, polymers comprising silicone and acrylic moieties, and the like. Polymers comprising silicone and acrylic moieties may include copolymers comprising silicone and acrylic moieties, polymer blends comprising a silicone elastomer and an acrylic elastomer, for example.

Materials used as an electroactive polymer may be selected based on one or more material properties such as a high electrical breakdown strength, a low modulus of elasticity—(for large or small deformations), a high dielectric constant, and the like. In one embodiment, the polymer is selected such that is has an elastic modulus at most about 100 MPa. In another embodiment, the polymer is selected such that is has a maximum actuation pressure between about 0.05 MPa and about 10 MPa, and preferably between about 0.3 MPa and about 3 MPa. In another embodiment, the polymer is selected such that is has a dielectric constant between about 2 and about 20, and preferably between about 2.5 and about 12. The present disclosure is not intended to be limited to these ranges. Ideally, materials with a higher dielectric constant than the ranges given above would be desirable if the materials had both a high dielectric constant and a high dielectric strength. In many cases, electroactive polymers may be fabricated and implemented as thin films. Thicknesses suitable for these thin films may be below 50 micrometers.

As electroactive polymers may deflect at high strains, electrodes attached to the polymers should also deflect without compromising mechanical or electrical performance. Generally, electrodes suitable for use may be of any shape and material provided that they are able to supply a suitable voltage to, or receive a suitable voltage from, an electroactive polymer. The voltage may be either constant or varying over time. In one embodiment, the electrodes adhere to a surface of the polymer. Electrodes adhering to the polymer are preferably compliant and conform to the changing shape of the polymer. Correspondingly, the present disclosure may include compliant electrodes that conform to the shape of an electroactive polymer to which they are attached. The electrodes may be only applied to a portion of an electroactive polymer and define an active area according to their geometry. Various types of electrodes suitable for use with the present disclosure include structured electrodes comprising metal traces and charge distribution layers, textured electrodes comprising varying out of plane dimensions, conductive greases such as carbon greases or silver greases, colloidal suspensions, high aspect ratio conductive materials such as carbon fibrils and carbon nanotubes, and mixtures of ionically conductive materials.

Materials used for electrodes of the present disclosure may vary. Suitable materials used in an electrode may include graphite, carbon black, colloidal suspensions, thin metals including silver and gold, silver filled and carbon filled gels and polymers, and ionically or electronically conductive polymers. It is understood that certain electrode materials may work well with particular polymers and may not work as well for others. By way of example, carbon fibrils work well with acrylic elastomer polymers while not as well with silicone polymers.

The active material may also comprise a piezoelectric material. Also, in certain embodiments, the piezoelectric material may be configured as an actuator for providing rapid deployment. As used herein, the term "piezoelectric" is used to describe a material that mechanically deforms (changes shape) when a voltage potential is applied, or conversely, generates an electrical charge when mechanically deformed. Employing the piezoelectric material will utilize an electrical signal for activation. Upon activation, the piezoelectric material will assume an arcuate shape, thereby causing displacement in the powered state. Upon discontinuation of the activation signal, the strips will assume its original shape orientation, e.g., a straightened shape orientation.

Preferably, a piezoelectric material is disposed on strips of a flexible metal or ceramic sheet. The strips can be unimorph or bimorph. Preferably, the strips are bimorph, because bimorphs generally exhibit more displacement than unimorphs.

One type of unimorph is a structure composed of a single piezoelectric element externally bonded to a flexible metal foil or strip, which is stimulated by the piezoelectric element when activated with a changing voltage and results in an axial buckling or deflection as it opposes the movement of the piezoelectric element. The actuator movement for a unimorph can be by contraction or expansion. Unimorphs can exhibit a strain of as high as about 10%, but generally can only sustain low loads relative to the overall dimensions of the unimorph structure. A commercial example of a pre-stressed unimorph is referred to as "THUNDER", which is an acronym for THin layer composite UNimorph ferroelectric Driver and sEnsoR. THUNDER is a composite structure constructed with a piezoelectric ceramic layer (for example, lead zirconate titanate), which is electroplated on its two major faces. A metal pre-stress layer is adhered to the electroplated surface on at least one side of the ceramic layer by an adhesive layer (for example, "LaRC-SI®" developed by the National Aeronautics and Space Administration (NASA)). During manufacture of a THUNDER actuator, the ceramic layer, the adhesive layer, and the first pre-stress layer are simultaneously heated to a temperature above the melting point of the adhesive, and then subsequently allowed to cool, thereby re-solidifying and setting the adhesive layer. During the cooling process the ceramic layer becomes strained, due to the higher coefficients of thermal contraction of the metal pre-stress layer and the adhesive layer than of the ceramic layer. Also, due to the greater thermal contraction of the laminate materials than the ceramic layer, the ceramic layer deforms into an arcuate shape having a generally concave face.

In contrast to the unimorph piezoelectric device, a bimorph device includes an intermediate flexible metal foil sandwiched between two piezoelectric elements. Bimorphs exhibit more displacement than unimorphs because under the applied voltage one ceramic element will contract while the other expands. Bimorphs can exhibit strains up to about 20%, but similar to unimorphs, generally cannot sustain high loads relative to the overall dimensions of the unimorph structure.

Suitable piezoelectric materials include inorganic compounds, organic compounds, and metals. With regard to organic materials, all of the polymeric materials with non-centrosymmetric structure and large dipole moment group (s) on the main chain or on the side-chain, or on both chains within the molecules, can be used as candidates for the piezoelectric film. Examples of suitable polymers include, for example, but are not limited to, poly(sodium 4-styrenesulfonate) ("PSS"), poly S-119 (poly(vinylamine)backbone azo chromophore), and their derivatives; polyfluorocarbons, including polyvinylidene fluoride ("PVDF"), its co-polymer vinylidene fluoride ("VDF"), trifluoroethylene (TrFE), and their derivatives; polychlorocarbons, including poly(vinyl chloride) ("PVC"), polyvinylidene chloride ("PVDC"), and their derivatives; polyacrylonitriles ("PAN"), and their derivatives; polycarboxylic acids, including poly(methacrylic acid ("PMA"), and their derivatives; polyureas, and their derivatives; polyurethanes ("PU"), and their derivatives; bio-polymer molecules such as poly-L-lactic acids and their derivatives, and membrane proteins, as well as phosphate bio-molecules; polyanilines and their derivatives, and all of the derivatives of tetramines; polyimides, including Kapton molecules and polyetherimide ("PEI"), and their derivatives; all of the membrane polymers; poly(N-vinyl pyrrolidone) ("PVP") homopolymer, and its derivatives, and random PVP-co-vinyl acetate ("PVAc") copolymers; and all of the aromatic polymers with dipole moment groups in the main-chain or side-chains, or in both the main-chain and the side-chains, and mixtures thereof.

Further, piezoelectric materials can include Pt, Pd, Ni, Ti, Cr, Fe, Ag, Au, Cu, and metal alloys and mixtures thereof. These piezoelectric materials can also include, for example, metal oxide such as $SiO_2$, $Al_2O_3$, $ZrO_2$, $TiO_2$, $SrTiO_3$, $PbTiO_3$, $BaTiO_3$, $FeO_3$, $Fe_3O_4$, ZnO, and mixtures thereof; and Group VIA and IIB compounds, such as CdSe, CdS, GaAs, AgCaSe 2, ZnSe, GaP, InP, ZnS, and mixtures thereof.

Advantageously, the above noted hood latches utilizing the active materials described herein provide relatively robust systems compared to conventional hood latches. In addition to providing reversibility, the active material based actuators are relatively compact and are of significantly lower weight. Furthermore, it should be recognized by those skilled in the art that the latches as used herein may be configured to allow for increased ease of operation, more energy to be absorbed during an impact event, increased torsional stiffness, and more security against theft.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A latch, comprising:

a pin disposed on a first surface;

a gate disposed on a second surface opposing the first surface;

an active material in contact with the pin and configured to rotatably engage and disengage the pin from the gate, wherein the active material is a shape memory alloy, a shape memory polymer, a magnetorheological fluid, an electroactive polymer, a magnetorheological elastomer, an electrorheological fluid, a piezoelectric material, or a combination comprising at least one of the foregoing active materials;

an activation device in operative communication with the active material, wherein the activation device is operable to selectively apply an activation signal to the active material and effect a reversible change in a property of the active material, wherein the reversible change results in the engagement or disengagement of the pin from the gate through rotary motion of the pin; and a spring in operative communication with the pin or the gate, wherein the spring is configured to provide a force opposite to a force provided by the active material, wherein the activated active material is effective to overcome the force provided by the spring.

2. The latch of claim 1, wherein the first and second surfaces from a vehicle passenger door and jam, an engine lid and vehicle body, a storage compartment lid and jam, a fuel tank filler lid and vehicle body, a sunroof and vehicle body, a cargo hatch and vehicle body, a tail gate and vehicle body, trunk lid and vehicle body, or a lift gate and vehicle body.

3. The latch of claim 1, wherein the property undergoing reversible change is a dimension, a shape, a shear force, a shape orientation, a flexural modulus, a phase of matter, or a combination comprising one or more of the foregoing properties.

4. The latch of claim 1, wherein the disengagement is opposed by a physical obstruction, a friction between the pin and the gate, an interference fit between the pin and the gate, a pressure in a chamber of the gate, a component that must break away from the pin or the gate or a combination comprising at least one of the foregoing disengagement oppositions.

5. The latch of claim 1, further comprising one or more guides to facilitate the rotational engagement of the pin to the gate.

6. The latch of claim 1, wherein the pin and gate form a gravity gate latch, a three point latch, a C-latch, a T-latch, or an I-latch.

7. A latching method comprising:

producing an activation signal with an activation device;

applying the activation signal to an active material and causing a change in at least one property active material, wherein the active material is in contact with a pin, wherein the pin is disposed on a first surface and the gate of a latch is disposed on an opposing second surface; and engaging the gate from the pin through rotary motion of the pin by the change in at least one property of the active material to secure the first surface to the opposing second surface or disengaging the gate from the pin through rotary motion of the pin by the change in at least one property of the active material to make less secure the first surface to the opposing second surface, wherein the change in the at least one property of the active material produces a force effective to overcome an opposing force from a spring which is in operative communication with the pin or the gate.

8. The method of claim 7, wherein producing the activation signal comprises sensing an impact event.

9. The method of claim 8, wherein sensing is accomplished with a pre-impact sensor.

10. The method of claim 8, wherein sensing is accomplished with an impact sensor.

11. The method of claim 7, wherein producing the activation signal is a manual activation, electronic activation of a built-in logic system, or turning on or off the ignition.

12. The method of claim 7, wherein the activation signal is a thermal activation signal, a magnetic activation signal, an electric activation signal a chemical activation signal, a mechanical load, or a combination comprising at least one of tic foregoing activation signals.

13. The method of claim 7, wherein the active material is a shape memory alloy, a ferromagnetic shape memory alloy, a shape memory polymer, a magnetorheological fluid, a electroactive polymer, a magnetorheological elastomer, an electrorheological fluid, a piezoelectric material, or a combination comprising at least one of the foregoing active materials.

14. The method of claim 7, wherein the change in at least one property is a dimension, a shape, a shear force, a shape orientation, a flexural modulus, a phase of matter, or a combination comprising one or more of the foregoing properties.

15. The method of claim 7, wherein the change is reversible.

16. The method of claim 7, wherein the first and second surfaces form a vehicle passenger door and jam, an engine lid and vehicle body, a storage compartment lid and jam, a fuel tank filler lid and the vehicle body, a sunroof and vehicle body, a cargo hatch and vehicle body, a tail gate and vehicle body, trunk lid and vehicle body, or a lift gate and vehicle body.

17. The method of claim 7, wherein the pin and gate form a gravity gate latch, a three point latch, a C-latch, a T-latch, or an I-latch.

18. A T-hatch, comprising;

a T-shaped pin disposed on a first surface, wherein the T-shaped pin is in operative communication with a pin body comprising one or more torsion springs effective to exert a rotational force on the T-shaped pin;

a gate, disposed on a second surface opposing the first surface, shaped to receive and engage with the T-shaped pin;

an active material in operative communication with the T-shaped pin, wherein the active material is a shape memory alloy, a shape memory polymer, an electroactive polymer, a magnetorheological elastomer, or a combination comprising at least one of the foregoing active materials;

an activation device in operative communication with the active material, wherein the activation device is operable to selectively apply an activation signal to the active material and effect a reversible change in a property of the active material, wherein the reversible change results in an engagement or a disengagement of the T-shaped pin from the gate through rotary motion of the T-shaped pin.

19. The T-latch of claim 18, wherein the gate comprises one or more pin guides disposed near an entry point of the gate effective to facilitate alignment and engagement of the T-shaped pin with the gate.

20. The T-latch of claim 18, wherein, the pin body comprises one or more pin shaft bearings effective to facilitate rotation of the T-shaped pin.

* * * * *